United States Patent [19]

Fritzinger

[11] 4,200,860

[45] Apr. 29, 1980

[54] METHOD AND APPARATUS FOR SIGNALLING MOTORISTS AND PEDESTRIANS WHEN THE DIRECTION OF TRAFFIC WILL CHANGE

[76] Inventor: George H. Fritzinger, 15 Standish Ave., West Orange, N.J. 07052

[21] Appl. No.: 905,350

[22] Filed: May 12, 1978

Related U.S. Application Data

[63] Continuation-in-part of Ser. No. 681,539, Apr. 29, 1976, abandoned.

[51] Int. Cl.[2] ..... G08G 1/096; G08G 1/095

[52] U.S. Cl. ..... 340/43; 116/63 R; 340/41 R

[58] Field of Search ..... 340/43, 41 R, 37, 44, 340/42; 116/63 R

[56] References Cited

U.S. PATENT DOCUMENTS

| | | | |
|---|---|---|---|
| 2,016,220 | 10/1935 | Anderson | 340/43 |
| 2,057,186 | 10/1936 | Freeberg | 340/43 |
| 2,817,724 | 12/1957 | Skidgel | 340/43 |

*Primary Examiner*—John W. Caldwell, Sr.
*Assistant Examiner*—James J. Groody
*Attorney, Agent, or Firm*—George H. Fritzinger

[57] ABSTRACT

An apparatus of electromechanical or solid-state character is provided for intermittently blinking the traffic control signals at street and road intersections to inform motorists and pedestrians at intervals during each period the lights are red or green as to the time remaining before the lights are changed to green or red to indicate a change in direction of traffic. The apparatus includes an interrupter switch in the power line of the traffic lights and a timer for the interrupter switch cycled by a pulse from the controller of the traffic lights each time the lights are changed. During each cycle of the timer the interrupter switch is operated at intervals to provide distinguishing signals each differing by one blink from the other. For example, the traffic lights may be blinked once when 30 seconds remain before the lights will change and twice at a rate of 3 to 6 per second when 15 seconds remain. By this signalling, motorists are enabled to gauge their speed as they approach street and road intersections to save gasoline and to drive with maximum safety, and pedestrians can know in advance when they have sufficient time to walk across at an intersection with safety.

16 Claims, 9 Drawing Figures

FIG. 1
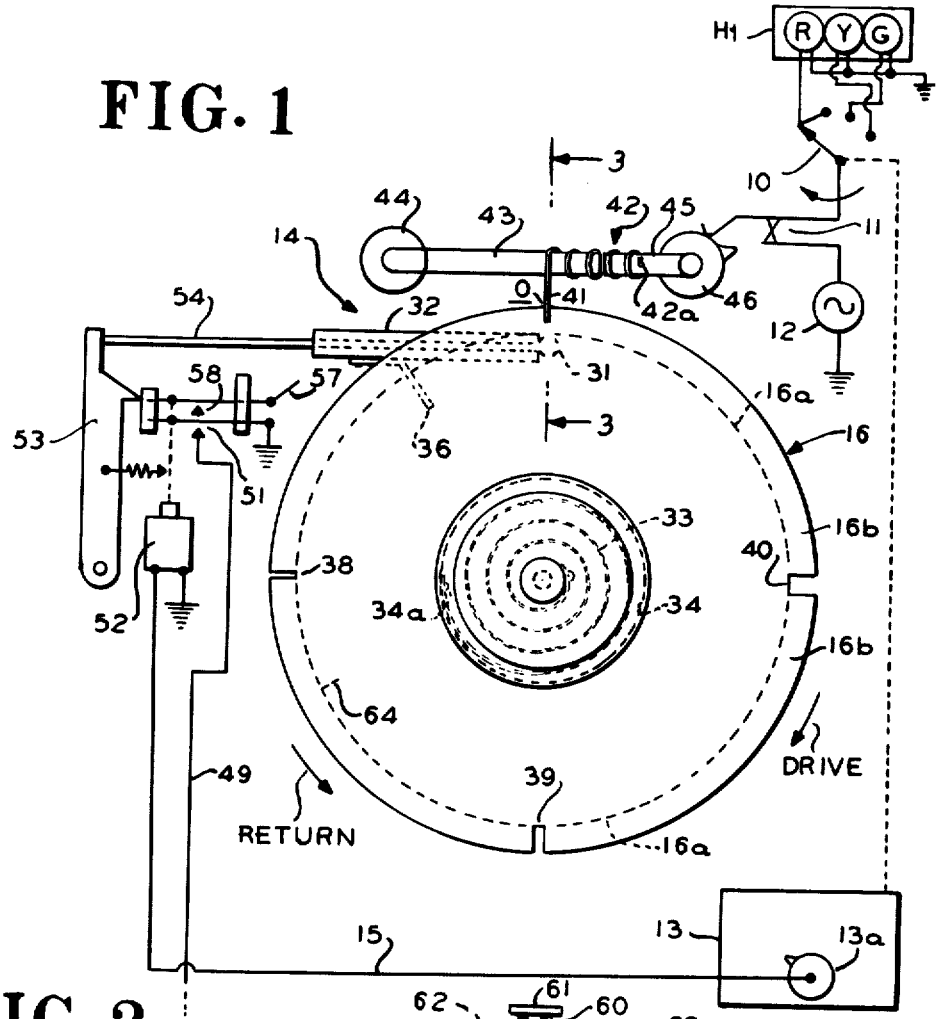
FIG. 2
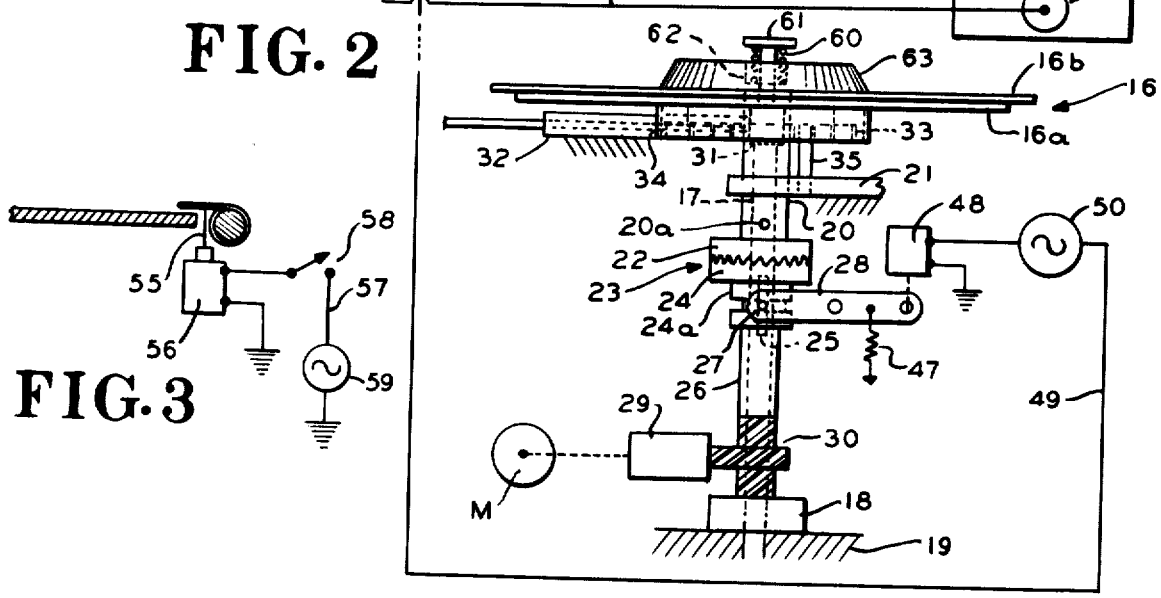
FIG. 3

FIG. 8
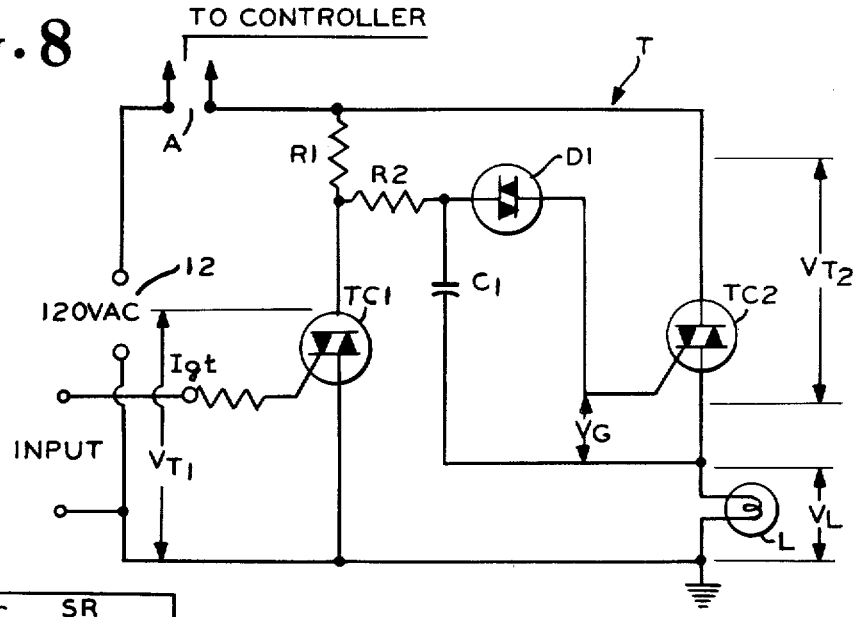
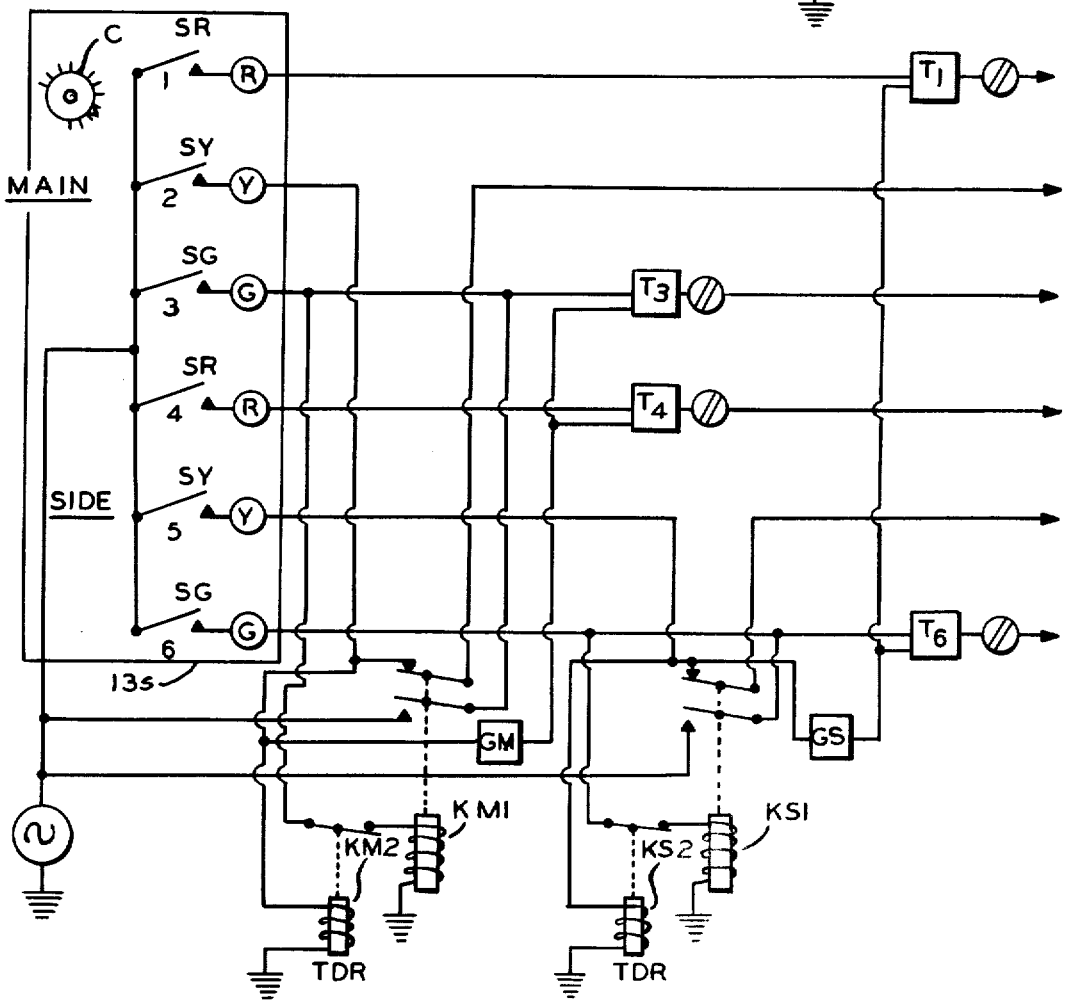
FIG. 9

METHOD AND APPARATUS FOR SIGNALLING MOTORISTS AND PEDESTRIANS WHEN THE DIRECTION OF TRAFFIC WILL CHANGE

This application is a continuation-in-part of my pending application Ser. No. 681,539 filed Apr. 29, 1976, and which is being abandoned upon the filing of this application.

The invention relates to a method and apparatus applicable to traffic intersection signalling systems without requiring any modification of the existing traffic control equipment for apprising motorists and pedestrians at successive intervals as to the time remaining before the direction of traffic will change.

Traffic intersection lights are alternated between red and green indications at prescribed periods to give motorists "stop" and "go" signals but give no indications as to when the direction of traffic will change. As a result, a motorist cannot gauge his speed to cope best with the changing lights. For example, he may drift up to a green light only to find that if he had driven a little faster he would have gotton through the yellow light before the light changed to red; or alternatively he may speed up only to find the light changing to red as he nears the intersection requiring then that he suddenly apply his brakes. In either case, he did not gauge his driving to achieve maximum safety or economy in gasoline consumption. Further, when he speeds up to make a green light and the yellow light comes on as he nears the intersection his driving becomes hazardous because any sudden stopping may cause an accident from behind and any speeding through the intersection may incur a forward collision with a crossing vehicle or pedestrian.

Further, for example, motorists tend to drive up to red lights at full speed and then apply their brakes and stop to wait for the lights to change. This not only results in a great waste of gasoline but imposes also safety hazards. Also, pedestrians when coming to an intersection to cross, will take a look first to see if the lights are red or green, and if red they start across but without any knowledge as to when the lights will change, with the result they often get caught in the middle in the midst of traffic with great risk to their safety.

With traffic growing heavier all the time, and with the present-day need for motorists to conserve gasoline as much as possible, it is obvious that traffic intersection signalling restricted merely to "stop" and "go" lights, without giving the motorist any advance knowledge as to when the lights will change, is grossly inadequate in meeting present-day traffic control needs both as to safety and economy.

By the present invention, the yellow caution light signal is supplemented by an accentuated multiple blink of the green light at 10 to 15 seconds before the light changes to red to give motorists ample time to make decisions without haste or confusion in preparation to the oncoming yellow light so that they will tend not to take the risk to themselves and to others of running through a red light. Also, by the blink signals of the red light motorists will learn the futility of rushing to the red light and then braking and waiting for the light to change, and will instead learn to time their approach with resultant saving in gasoline and with greater safety to themselves and to others. Further, pedestrians who already have an eye on the red light need only to learn to wait for a blink signal before starting across to know if they can cross safely.

The present invention resides in a simple method of signalling motorists and pedestrians of the time remaining before the signal intersection lights will change to indicate a change in direction of traffic, and resides further in a simple and economical apparatus for carrying out this method, which can be easily connected to existing traffic control systems without modifying the equipment. The method is simply to blink the traffic lights at intervals in a coded sequence which may be carried out by blinking the red-green lights once when a predetermined interval of 25 to 45 seconds remain before the lights will change to red or green, blinking the lights twice in rapid succession when 15 to 30 seconds remain, and blinking the lights three times when 10 to 15 seconds remain. Alternatively, it may be sufficient to provide only a two-interval signalling by blinking the red and green lights once at 25 to 30 seconds and twice at 10 to 15 seconds before the direction of traffic will change.

The blinking apparatus may be mechanical, electromechanical or solid state. In any case, it requires only a connection of an interrupter switch or switches in the power line to the signal lights and a control connection with the existing traffic controller to time the cycling of the blinking apparatus. The embodiments operate to blink both the red and green lights, but the invention comprehends as well the blinking of either the red or green lights in any given direction of a traffic intersection.

It is accordingly an object of the invention to provide an auxiliary time signalling in connection with existing traffic intersection stop-go signalling to enable motorists to drive with greater economy and with greater safety, and to enable pedestrians to gauge their crossing as to whether sufficient time still remains to cross safely.

It is another object to achieve the aforestated objective by means of an economical apparatus which can be connected to present-day traffic control systems, whether it be electromechanical or solid state, without requiring any modification of the present equipment.

It is a further object to provide such time signalling system which operates on a simple code basis to enable motorists and pedestrians to interpret the signals immediately.

It is another object to provide such time signalling which will also achieve greater safety by bringing intersection traffic signals more readily to the attention of motorists when the signals are not readily visible due to poor location and to obstructing objects.

Further, it is an object to provide a time signalling system for the purposes of the invention, which can be readily installed in connection with any single intersection lights or group of intersection lights without affecting any other intersections, thus enabling the present signalling system to be applied to whatever areas and to whatever extent may be desired.

The invention is described in the parent application as being connectible to the existing traffic control equipment and as providing momentary discrete signals by blinking only the red and green lights. The yellow light—which is set normally at 3 to 5 seconds—has become an indispensible part of the existing equipment, and is mentioned in the application as a part thereof, but was not shown in the drawings because there was no intention of ever blinking this light. Thus, and as is shown by the timing ascribed to the red and green blink signals, the present signalling occurs before the yellow light and is an adjunct or supplement thereto but in no way a replacement thereof. Further, the invention comprehends obtaining the present signaling from the red and green signal lights while they are "ON" giving their normal signal indications. Thus, in accordance with the invention, there is only one light showing at any one time in any given direction, the same as with the existing equipment.

Further, the invention comprehends providing signals of a discrete character by momentarily blinking—i.e., one or more times—the red and/or green lights followed by a continuing "ON" condition of the light. In the illustrative examples, there has been disclosed 3-blink, 2-blink and single-blink signals in the range from 45 to 10 seconds before the direction of traffic is changed, with the blinks of each multiple blink signal being described as being at a rate of from 3 to 6 cycles per second. Although it was not specifically mentioned, it is inherent that the maximum duration of any one signal in these illustrative examples is one second—which is that of a 3-blink signal at a rate of 3 cycles per second. The one-second duration for a multiple blink signal is a limit for purposes of the invention, but it is comprehended that within this second or portion thereof there may be more than 3 blinks at a correspondingly faster rate up to 6 cycles per second to form a signal in the nature of a "burst". This is especially appropriate for the blink signal of the green light just preceding the yellow light by a short interval.

The blink signalling which has been proposed is clearly distinct from a flash signalling primarily by being at a 3 to 6 times faster rate. The "off" duration of each blink cycle may be varied within the scope of the invention but as multiple-blink signals are at blink rates at least 3 times faster than a flash signal the maximum duration of a single blink is preferably at most one-third of the illuminated period of 500 ms of a flash signal—i.e., of the order of 165 ms.

Although the invention has been described as comprehending the blinking of the red and/or green lights, it is preferred in order to accomplish the maximum objectives that both the red and green lights in cross directions are blinked simultaneously so that signalling is provided to motorists and pedestrians in both directions of traffic at an intersection. Since the blinking is timed to occur before the yellow light comes on, the yellow light may be powered either through the blinking switch or direct from the power source, the determintion being made on the basis of achieving maximum circuit simplicity and economics.

In the prior application, the red light has been considered as a "stop" signal, and the green light along with the yellow light has been considered as a "go" signal. Applicant's terminology of shifting the lights "between red and green indications" to provide "stop" and "go" signals is therefore a usage showing that the term "green indication" necessarily included the yellow light. In order to avoid the strained terminology of a "green indication" including the yellow light, the yellow light is now shown in the drawings, the red light is considered a "stop" signal, the green light as a "go" signal and the time of the sequence of green and yellow lights leading to the red light is referred to as the "green-yellow" period, but the timing of the blink signalling is no longer referred to in terms of "stop" and "go" signalling. Instead, this timing is defined as running from the moments the lights change to red and to green—which is also the moment when the lights indicate a change in the direction of traffic.

The prior art comprises a Freeberg U.S. Pat. No. 2,057,186 which teaches a signalling intended to accomplish the same general purposes. But Freeberg's signalling is in terms of "flashing" and not blinking and would be totally unacceptable because flashing has acquired a definite meaning in the traffic control field of indicating a hazardous condition. Further, Freeberg's signalling is additional to the reqular signal lights because his teaching is to flash the red light while the green light is "on" giving its "go" signal, to flash the green light while the red light is "on" giving its "stop" signal, and to flash the yellow light at times when the red and green lights are giving their normal signals. Applicant provides only one signal light in anyone direction at anyone time. Still further, Freeberg never teaches any discrete signal giving any definite time indication because every flash signal which he provides is a continuing one which is started at some indefinite time within a signal period and once started is left to run to the end of the period until the direction of traffic is changed. Applicant blinks the red or green light while it is giving the regular signal followed by a steady "on" condition of the light. In one instance in FIG. 8 Freeberg shows a time chart described only as showing "a steady green portion, followed by a flashing green portion, which, in turn, is followed by a steady red portion". This is a proposal to flash the green light for a terminating interval in replacement of the regular yellow light. All of applicants blink signalling is an additional signalling supplementing the yellow light and not replacing it.

These and other objects, features and distinctions of the invention will be apparent from the following description and the appended claims.

In the description of the invention, reference is made to the following drawings, of which:

FIGS. 1 and 2 are respectively, plan and elevational views of a mechanically operated interupter together with electrical circuitry for connecting the same to a traffic intersection control system to provide a timed blinking of the traffic lights in any one direction of an intersection to apprise motorists when the direction of traffic will change;

FIG. 3 is a fractional view taken on the line 3—3 of FIG. 1;

FIG. 8 is a circuit diagram of a standard form of solid-state triac switch as used in a solid-state embodiment of the invention; and FIG. 9 is a circuit diagram showing an application of the invention to a traffic actuated solid-state controller to provide a blink signal preceding the yellow light.

Figure 4:
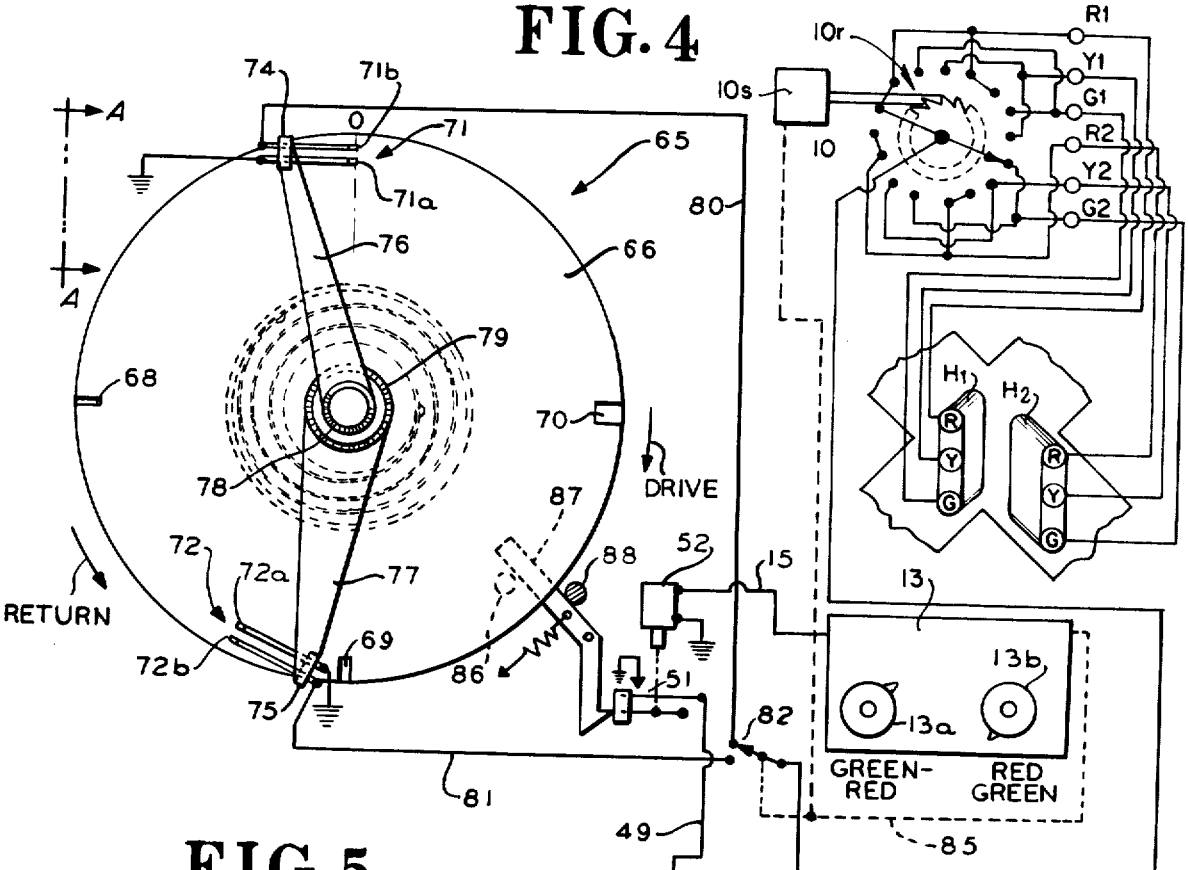
FIGS. 4 and 5 are respectively, plan and elevational views of an electromechanically operated interrupter apparatus for the purpose described, which is applicable to existing intersection signalling systems which have an unequal division of the red-green cycle time, a portion of FIG. 5 at line A—A being shown as it would appear from the line A—A of FIG. 4.

In the mechanical system of FIGS. 1, 2 and 3, there is shown a single sign head $H_1$, by way of illustration, comprising red, yellow, and green traffic lights R, Y and G connected through a stepping switch 10 and an interrupter switch 11 to a power source 12 typically a 110 volt AC power line. The stepping switch may be operated by a solenoid 10*s* through a ratchet 10*r* as shown in FIG. 4, all of which is part of a standard controller 13 (diagrammatically shown). The interrupter switch 11 is operated by a timing mechanism 14 to blink the signal lights R and G in a preset pattern during each period the traffic lights, as they appear from either direction, are on red or green. A control pulse is taken from the controller 13, via a line or connection 15 to reset the timing mechanism at the beginning of each red and green period.

In FIGS. 1 and 2, the timing mechanism 14 is of a mechanical type comprising a turntable 16 having a central shaft 17 journalled at its bottom portion in a bearing 18 mounted on a frame member 19. A sleeve 20 pinned a 20*a* to the upper part of the shaft 17 is journalled in a frame member 21 and has a clutch member 22 secured thereto and engageable with a lower clutch member 24 of a clutch 23. The clutch member 24 and its hub 24*a* are slidably mounted on and splined at 25 to a sleeve 26 (FIG. 2). The lower clutch member has a pin-groove coupling to a lever 28 operable to shift the clutch member into and out of engagement with the upper clutch member while remaining coupled to the sleeve 26. This sleeve is rotated on the shaft 17 by a motor M having a shaft 29 coupled by worm gearing 30 to the sleeve. The turntable has a pin 31 depending therefrom which defines a home or "zero" position therefor by its abutment against a stop member 32 on the frame. The turntable is driven clockwise when the clutch is engaged, but the instant the clutch is disengaged within a revolution of travel of the turntable the same is snapped back to home position, to reset the timing mechanism 14, by a spiral spring 33 within a circular flange 34 on the bottom side of the turntable, the spring having its outer end secured to the flange at 34*a* (FIG. 1) and its inner end secured to a pin 35 on the frame member 21. Any attempted inadvertent overdrive o the turntable beyond about one revolution is prevented by movement of the pin 31 against a safety switch 36 (FIG. 1) mounted on the frame member 32 and connected in the circuit of the motor M.

The turntable 16 may, for example, have three peripheral slots 38, 39 and 40 at one-quarter turn spacings representing 15 seconds intervals from home position. These slots are engageable successively by a radial tang 41 of a one-revolution spring clutch 42 as the turntable is driven by the motor M. The spring clutch couples a shaft 43 of a synchronous motor 44 to a shaft 45 of a one-lobe cam 46 for opening momentarily the interrupter switch 11 once during each revolution of the cam. As long as the tang 41 is held from turning by its sliding engagement with the peripheral rim of the turntable, the clutch is held disengaged. The instant the tang is freed by one of the slots 38–40, the clutch is engaged to turn the cam by one or more revolutions depending on the widths of the slots. In order that the cam 46 is always stopped in the same position, the far end of the spring clutch is secured at 42*a* to the shaft 45.

The turntable may have for example, a diameter of 6" causing it to have a peripheral speed of 0.314" per second when driven at one revolution per minute. At a blinking rate of five per second, the turntable has a peripheral movement of 0.0625" (approx. 1/16") during each revolution of the cam 46. Assuming the tang 41 has a width of 1/32", a suitable width for the peripheral slot 38 may be 0.050" to allow the tang to clear the slot only once to produce a single blink as the slot 38 moves past the tang. The second peripheral slot 39 may then have a width 1/16" greater, i.e., 0.112, to allow the tang to clear for two revolutions to produce two blinks, and the slot 40 may be another 1/16" wider, i.e., 0.174", to allow the tang to clear for three revolutions to produce three blinks. Thus, at 15 seconds after reset of the timing mechanism—which is 15 seconds after start of the turntable from home position—the red and green lights will be blinked once, at 30 seconds they will be blinked twice and at 45 seconds they will be blinked three times. Of course, any other suitable intervals between successive blinking signals may be chosen.

The clutch 23 is biased closed by a spring 47 and is disengaged by a solenoid 48 when the solenoid is energized. The solenoid is connected in a circuit 49 including a power source 40 and a normally open switch 51. This switch is closed by operation of a solenoid 52 connected in the pulse circuit 15 leading from the controller 13. A single electrical pulse on this line from the controller each time the controller actuates the ratchet solenoid to connect the switch 10 to a red or green light will close the switch 51 momentarily to disengage the clutch 23 and start a snap back of the turntable to home position. The instant the switch 51 is closed, it is latched by a latch member 53 to cause the clutch to be held disengaged during the full return of the turntable but when the turntable reaches home, the stop pin 31 strikes against a push rod 54 slidable on the frame member 32 to release the latch 53 and cause the switch to be opened. This causes the clutch to be reengaged by the spring 47 to start again a forward drive of the turntable. Thus, the turntable is reset to start a new cycle each time the switch 10 is operated to shift the traffic lights to red or green. Since there is no blinking timed to occur during the several second interval preceding the instant the direction of traffic is changed, the yellow light may be connected through the normally closed interrupter switch 11.

In order that the tang 41 will not be released to engage the spring clutch 42 during the return of the turntable to home position, a blocking member 55 below the tang is raised by a push-type solenoid 56 as shown in FIG. 3. This solenoid is connected in a circuit 57 including a series switch 58 and power source 59. The switch 58 is operable closed by the solenoid 52 when the controller 13 is operated to change the traffic lights to red and green, and is held closed to withhold the tang from the turntable until the latch 53 is released by the turntable reaching the home position.

In order that the timing mechanism 14 can be set to different time periods, the turntable is comprised of a bottom plate 16*a* secured to the shaft 17 and a top plate 16*b* overhanging portion thereof (FIGS. 1 and 2), which is held frictionally to the bottom plate by a central compression spring 60 interposed between the head 61 of a screw threaded into the end of the shaft 17 and the bottom wall of a well 62 in a knob 63 secured to the top plate (FIG. 2). A shifting of the top plate 16*b* clockwise relative to the bottom plate 16*a* sets the timing mechanism 15 to shorter red and green time periods. This shifting is done to set the cycling of the timing mechanism in correspondence with the shifting of the traffic lights. As shown in FIGS. 1 and 2, the timing mechanism is set at a 60 second interval to correspond to 60 second periods of the traffic lights on red and green-yellow. If the periods of the traffic lights is made shorter, say to 40 seconds, the top plate is adjusted by turning the knob 63 120 degrees clockwise relative to the plate 16*a* to bring a point 64 betwen to home position. This means that in 10 seconds after the traffic lights are changed, the slot 39 passes the tang 41 to produce a double blink of the traffic lights signifying that in 30 seconds the direction of traffic will change. The moment the traffic lights change, the timing mechanism will again be reset to start a new cycle.

Figure 5:
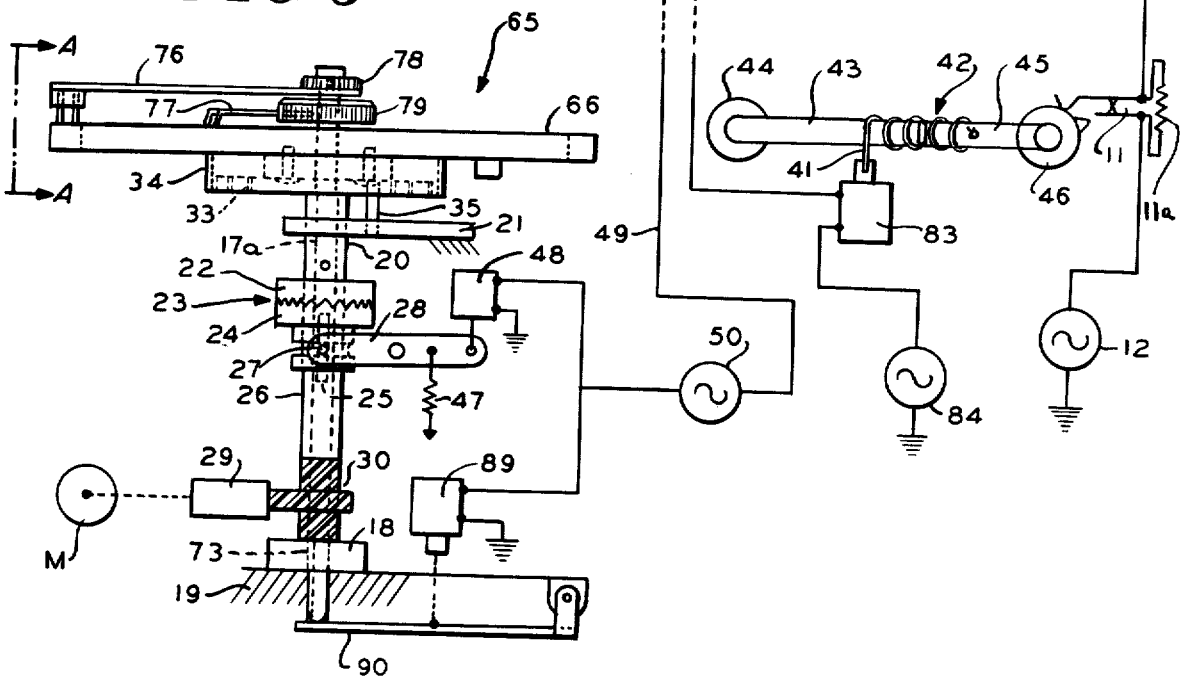

The embodiment of FIGS. 4 and 5 differs from that of FIGS. 1-3 principally in that it employs a timing mechanism 65 of an electromechanical type which is applicable to traffic control systems set to different red and green time periods to cope with situations where one street or road at an intersection carries a heavy traffic and the other relatively light traffic. In this second embodiment, two sign heads $H_1$ and $H_2$ in cross directions are shown, and parts which are the same as in the previous embodiment are given the same reference numbers.

A turntable 66 is in this embodiment of an insulative material such as Bakelite into which there are molded, for example, three conductive bars 68, 69 and 70, either on radii as shown or along the periphery, having a progressively greater width the same as the slots 38-40 of the first embodiment. Slidably engaging the rim of the turntable are two brush sets 71 and 72, each comprising two brushes designated by the suffix letters a and b, the two brushes of each set being spaced radially of the turntable within the length dimension of the conductive bars so that they become electrically interconnected momentarily as the bars pass the brushes during rotation of the turntable. The drive of the turntable 65 is the same as for the turntable 16 but the mounting of the turntable differs in that the center shaft 17*a* is splined at 73 to the frame bearing 18 and the upper sleeve 20 which carries the turntable 66 is rotatable on this shaft.

The brush sets 71 and 72 are molded in respective insulating blocks 74 and 75 which are in turn carried by respective radial arms 76 and 77. These arms are secured to respective knobs 78 and 79 which are frictionally pressed onto the upper part of the shaft 17*a* above the turntable to permit the brush sets to be independently adjusted rotatably relative to the home position of the turntable. The brush sets are in control circuits 80 and 81 connectable alternately by a switch 82 is operated as the switch 10 is operated from red to green, and vice versa, as represented by the tie line 85. Thus, as shown in FIGS. 4 and 5, the brush set 71 is connected to the solenoid 83 when the traffic lights of Head $H_1$ are on the green-yellow period, and the brush set 72 to the solenoid 83 when the traffic lights of Head $H_1$ are on red. The solenoid 83 has a plunger normally blocking the tang 41 of the one-revolution spring clutch 42 to hold the clutch normally disengaged. When the solenoid 83 is actuated, the plunger is withdrawn to cause the clutch to engage and start rotation of the cam 46 by the motor 44.

As in previous embodiment, the drum 66 may, for example, be driven at a rate of one revolution per minute, causing the conductor bars 68-70, when spaced at 90° intervals, to pass the brush set 71 at 15, 30, and 45 second intervals during the drive of the turntable clockwise from home position. Further, the drum may have a diameter of 6", giving it a peripheral speed of 0.314" per second, and the cam 46 may be driven at a rate of 5 revolutions per second with the result that the turntable has a peripheral travel of approximately 1/16" for each revolution of the cam. Assuming that the first conductor bar 68 and the tips of the brushes are each 0.020 inches wide peripherally of the turntable, the same will make electrical contact during 0.040" travel of the turntable as a maximum, which is about two-thirds of the time of one revolution of the cam 46. The instant the brushes 71*a* and 71*b* are interconnected by the bar 68, the solenoid 83 is energized to start a drive of the cam 46 but before one revolution is completed, the circuit is broken to cause the clutch to be disengaged on completion of one revolution of the cam. Thus, there is produced a single blink of the traffic lights at 15 seconds after the turntable is started from home position signifying that the traffic lights will change in 45 seconds. The conductor bar 69 is made 1/16" wider to cause the cam 46 to be driven two revolutions as the bar passes the brush set 71 to produce a double blink of the traffic lights signifying that 30 seconds remain before the direction of traffic will change, and the conductor bar 70 is made another 1/16" wider to cause the cam 46 to be driven three revolutions as the bar passes the brush set 71 to produce a triple blink of traffic lights signifying that only 15 seconds remain before the direction of traffic will change. The cam 46 is only illustrative, it being understood that the peripheral length of the lobe would be varied to obtain the desired duration of each blink.

It is presumed in the drawing in FIGS. 4 and 5 that the controller 13 is set as by a knob 13*a* to hold the green-yellow light on for about 60 seconds. At the end of that period, the turntable will hve been driven about one revolution from home position defined by abutment of a pin 86 on the turntable against a latch lever 87 itself stopped by a pin 88. As the controller 13 operates the switch 10 to change the green-yellow lights to red, it feeds a pulse on line 15 to solenoid 52 closing switch 51 into position latched by lever 87 to complete the power circuit 49 through solenoids 48 and 89. Solenoid 48 therefore disengages the drive clutch 23 and solenoid 89 raises lever 90 to lift shaft 17*a* whereby to raise the brush sets from the turntable. The turntable is therefore snapped back to home position by spiral spring 33 while both brush sets are held raised out of contact with the turntable. Just as the turntable reaches home position, it shifts latch lever 87 from the switch 51 releasing the switch to open position. This drops solenoids 48 and 89 to cause the drive clutch 23 to be reengaged by spring 47 and to return the brush sets onto the turntable, starting thus another cycle of the timing mechanism 65.

Concurrently as the switch 10 is shifted to the red traffic light, the switch 82 is shifted to the brush set 72 as indicated by the tie line 85. This is so that the timing mechanism 65 will be on a different time cycle to correspond to a different time period for the red light. Assuming the red light period is set, as by knob 13*b*, at 38 seconds the brush is set at a 38/60 interval clockwise from home position. Thus, as shown in FIG. 4, in 8 seconds after start of drive of the turntable from home position, the brush set engages the bar 69 to produce a double blink of the traffic lights indicating that the red light will change in 30 seconds and 15 seconds later the brush set 72 contacts the bar 70 to produce a triple blink, signifying that in 15 seconds the red light will change. When at the end of the 38-second period, the controller 13 switches the switch 10 over to the green light, the timing mechanism is reset to home position as before, and the brush 71 is returned in circuit to place the timing mechanism back to a 60 second period corresponding to that of the green-yellow lights. As $Head_1$ goes through the cycle red-green-yellow, the Head $H_2$ goes green-yellow-red.

In a practical effort to determine the most appropriate signalling for the purposes of the present invention, it is found that the maximum distance traffic lights can be generally seen along city streets with good visibility is from 1000' to 1500' depending on the weather, street curvatures, obstructions, etc. Assuming that the average speed in approaching intersections in city driving is 30 mph and that the first signal, say a single blink, should be set at the time required to travel the maximum viewing distance going at 30 mph, it follows that the first signal should be around 30 seconds because at 30 mph one travels approximately 1350'. An appropriate second signal, i.e., a double blink, may then be around 15 seconds before the lights change representing a maximum distance of 670'.

This same time signalling seems to be appropriate also for highway driving. Assuming the average speed approaching intersections on highways is 50 mph, a first signal at 30 seconds would occur at a maximum distance of 2200' from the intersection and a second signal at 15 seconds would occur at a maximum distance of 1100'. Since highway signals are normally in plainer view, they can generally be seen with good visibility at these distances.

If factors decreasing visibility such as haze, rain, road curvatures and obstructions are taken into consideration, it may be desirable to reduce the signalling intervals to 25 seconds and 10 seconds respectively before the direction of traffic will change—which would be at maximum distances of 1100' and 450' respectively when traveling at 30 mph and maximum distances of 1830' and 730' when going at 50 mph. But in this case, in order to cope best with conditions when vision is good, it may be desirable to provide a three signal system—i.e., a single blink at 35 seconds, a double blink at 25 seconds, and a triple blink at 10 seconds.

In all of the foregoing systemts, the signals at or about 25 seconds and at 10 to 15 seconds before the direction of traffic will change are of inestimable value to pedestrians because it enables them to avoid starting to walk across streets and roads at intersections when there is insufficient time remaining to cross.

Figure 6:
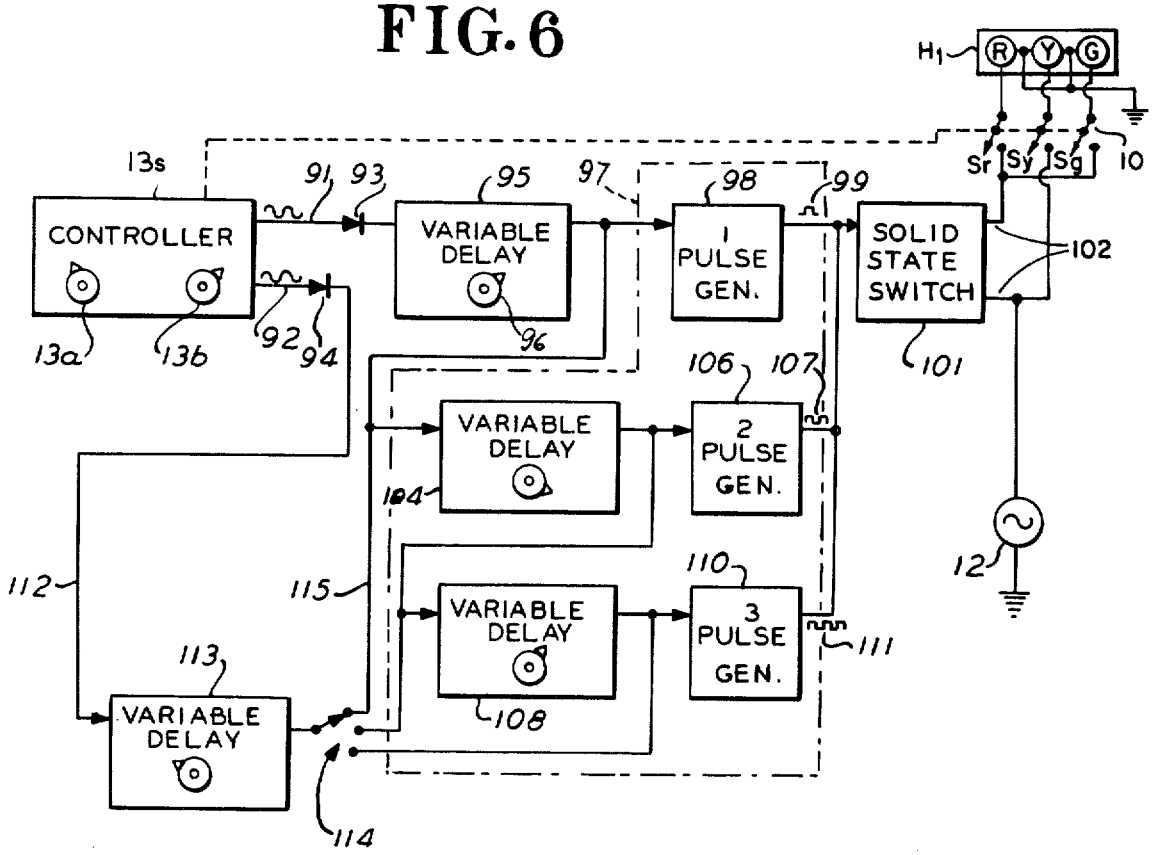
FIGS. 6 and 7 are block diagrams of solid state systems for carrying out the present invention.

A solid-state system capable of providing up to three signals is illustrated by the block diagram of FIG. 6, wherein each of the time delay and pulse generating components is of the self-resetting type. A solid-state controller 13s is shown in connection with a single head $H_1$. This is a standard controller having signal switches Sr, Sg and Sy in the respective lines to the red, green and yellow lights, which are operated on a selected time basis in the sequence here named. The controller 13s has also two output leads 91 and 92 from which ac voltages can be taken as the signal switches Sr and Sg are closed to activate the red and green lights. These control voltages are fed through one-half rectifiers 93 and 94 to derive dc control pulses. When the switch Sr is closed, the pulse via the rectifier 93 is fed to a variable delay gate 95 settable as by a knob 96 to delays from 5 to 30 seconds. The delayed pulse from this gate is fed to a step counter 97 wherein it is received by a 1-pulse generator 98 which immediately sends out an umplified dc pulse, represented at 99, to a solid-state switch 101. This switch operates to interrupt momentarily a power circuit 102 therein, which is connected in the power line from the power source 12 to the traffic light R. In response to this single input pulse 99, the solid-state switch 101 interrupts the power line momentarily to provide a single blink of the red lights.

At the same time that a pulse was fed to the generator 98 the same was fed also to a delay gate 104 of the counter 97. The delayed output pulse from this gate is fed to a 2-pulse generator 106 which thereupon sends out immediately an amplified double pulse, represented at 107, to the solid state switch 101. This double pulse, set at a rate of say 5 per second, will activate the solid-state switch 101 to interrupt the power line twice to produce a double blinking of the red light. Similarly, the pulse from the delay gate 104 is fed simultaneously to a third delay gate 106. The delayed pulse from this gate is fed to a 3-pulse generator 110 which thereupon sends out an amplified triple pulse, represented at 111, to the solid-state switch 101 to produce a triple blinking of the red traffic signal light. If the controller is set to hold the red light R for a period of 60 seconds, the variable delay gate 95 is set at 25 seconds to start the first blinking signal at 35 seconds before the traffic lights change to indicate a change in direction of traffic. If the delay gates 104 and 108 are set respectively at delays of 10 and 15 seconds, the remaining blinking signals occur respectively at 25 and 10 seconds before the lights change.

When the controller closes the switch Sg a control voltage from line 92 is fed through rectifier 94 to the variable delay gate 113. If the time period of the green-yellow lights is below the 35 second time for the first blinking signal, say at 30 seconds, then the switch 114 is shifted to its second position to cut out the single blink signal, and the variable delay gate 113 is set at 5 seconds so that the 2-pulse generator will produce a double blink signal at 25 seconds before the lights change to indicate a change in direction of traffic. Fifteen seconds later the 3 pulse generator will produce a triple blink signal at 10 seconds before the lights change to red or green.

If the green-yellow period is set below 25 seconds, say at 20 seconds, the variable delay gate 113 is set at 10 seconds and the switch 114 is set to its #3 contact connected direct to the 3 pulse generator so as to provide only a triple blink signal at 10 seconds before the direction of traffic changes.

Figure 7:
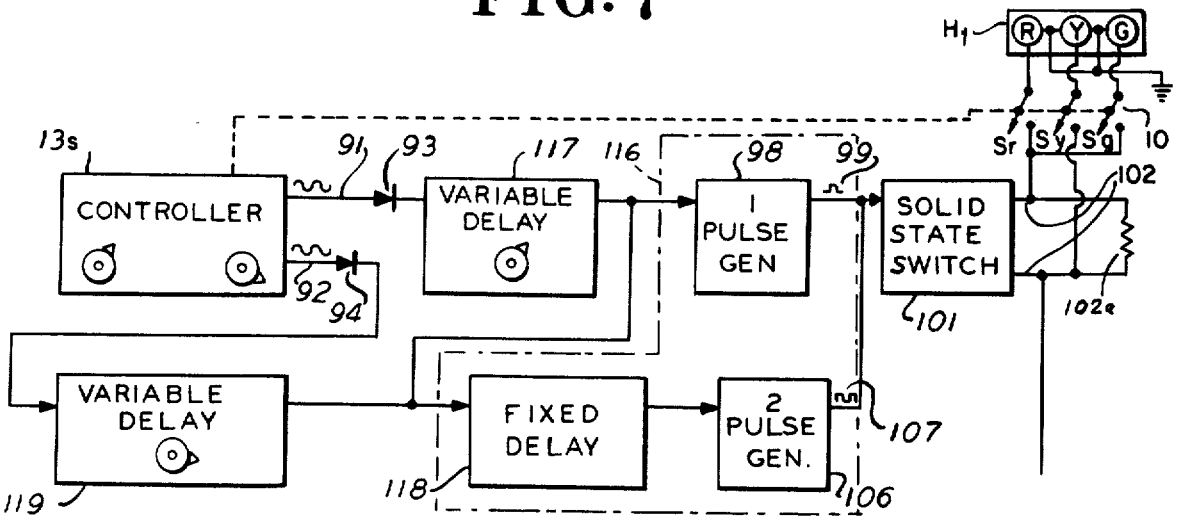

In the solid-state circuit shown in FIG. 7, a system is shown for providing only first and second blinking signals respectively at 25 and 10 seconds before the direction of traffic is changed. If the red signal period is 60 seconds and the green-yellow period is 40 seconds, the control pulse via the rectifier 93 is fed to a variable delay gate 117 set at 35 seconds. The delayed pulse from this gate is fed to a delay gate 118 set at 15 seconds. This delayed pulse is fed to the 2 pulse generator 106 to provide a double blink signal at 10 seconds before the direction of traffic changes. When the controller 13s shifts the lights to green, a control pulse is fed to a variable delay gate 119 which feeds both to the 1 pulse generator 98 and the delay gate 118. Thus, there is again produced single and double blink signals now of the green light at a spacing of 15 seconds. When green-yellow period is set to 40 seconds, the variable delay gate 119 is set to 15 seconds so that the blinking signals of the green light will occur also at 25 and 10 seconds respectively before the direction of traffic changes. This embodiment shows the simplicity of the control apparatus of the invention for any one system of signalling the time remaining before the direction of traffic changes since it is only necessary to adjust the apparatus to the periods of the red and green-yellow traffic signals.

In the foregoing solid-state systems, the solid-state switch 101 may be replaced simply by a solenoid operating a normally closed switch in the power line of the signal lights to open the power line momentarily in response to each current pulse fed to the solenoid. Further, instead of using an interrupter switch by itself to break the power circuit to produce the blinking signals, this switch may be shunted by a resistor as shown for example by the resistor 11a in FIG. 4 and the resistor 102a in FIG. 7. This would cause the signals to be more in the nature of a flicker but could be equally detectable by proper adjustment of the shunting resistor; and, also, the resistor would be beneficial in prolonging the life of the light bulbs. In the claims, the term "blink" is meant to comprehend also a flicker; also, the term "blink", or "blinking" is used to comprehend one or a plurality of blinks at a rate of from 3 to 6 per second for a duration of from one-half to one second maximum.

FIG. 8 shows a solid state switching unit T which may comprise the switch 101 in FIGS. 6 and 7, and be used as well in place of the electro-mechanical switching shown in the embodiments of FIGS. 1 and 4. The unit T is preferably a standard triac switching unit of the negative logic type comprising a power triac TC2 connected in series with the red or green signal light L and the signal leads of the controller via the terminals A to the power source 12. When TC1 is triggered on by an input pulse, TC2 and the signal light L are off. When TC1 is off, the condenser C1 is charged through the resistors R1 and R2 until breakover of a diac D1 occurs, at which time C1 discharges into the gate of TC2 to turn on the signal light L. Since the output triac TC2 is closed when the input control voltage is zero, and failure of the input circuitry tends always to produce a zero output voltahe the equipment is designed to fail safe.

The blinking circuitry shown in FIG. 9 is adapted for use with traffic actuated controllers preferably of the solid-state type, but this embodiment is not claimed herein since it is the subject of a subsequent application. Traffic actuated controllers operate on a floating basis depending on the flow of traffic until (1) either the green signal times out to within the yellow light setting, typically 3 to 5 seconds, of its extension limit when no calls on the opposite phase are received, or (2) it times out to within the yellow light setting of a unit extension when calls are received on the opposite phase. In either case the timing for a blink signal must stem from the instant the setting of the yellow light is reached. This prescribes the use of a blink signal a short interval ahead of the yellow light. Since the yellow light is set by a control knob C on the front panel of the controller 13s to from 3 to 5 seconds, this blink signal would be set typically from 6 to 8 seconds from the instant the direction of traffic is changed—which is 3 seconds ahead of the yellow light. A preferred signal is a multiple blink of a number up to a "burst" as before described for a limited duration of one second maximum, and preferably less at around one-half second.

An adjunct for accomplishing the aforestated objective comprises for the main road a standard power relay KM1 and a standard normally closed delay relay KM2, marked TDR. The power relay is preferably of the solenoid cam-actuated type to assure against any switching failure. These power and delay relays are connected respectively from the terminals of the controller 13s for the green and yellow lights, hereinafter referred to as the green and yellow terminals, for the main road back to ground with the normally closed contacts of the delay relay in series with the coil of the power relay. The power relay has one set of normally closed contacts connecting the yellow terminal to the yellow signal light, and a second set of normally open contacts for connecting the power source 12 to the green terminal in shunt with the respective controller switch Sg. The power relay is operated the instant power is fed to the green terminal to shunt the controller switch Sg and at the same time to open the circuit to the yellow light long before power is fed to the yellow terminal. When power comes to the yellow terminal it triggers a monostable pulse generator Gm to feed multiple pulse signals to the triac units T3 and T4 whereby to cause a multiple blink of the green light on the main road and a multiple blink of the red light on the side road. The delay relay is energized at the same time but the relay has a delayed operation according to its setting, say 3 seconds, to drop the power relay KM1 to cut off the green light and to start the yellow light three seconds after the blink signal.

In operation, the yellow control knob C is set to a longer interval than desired for the yellow light by the time desired for the blink signal to precede the yellow light, but at this controller setting only the blink signal occurs. The delay relay is set to a time interval equal to the time the controller is set ahead of the desired yellow light, with the result the light is cut off and the yellow light comes on at the desired timing for the yellow light.

The second adjunct for the side road operates in the same manner starting the instant power is fed to the green terminal for the side road. In this second adjunct the power and delay relays are KS1 and KS2, and the pulse generator is Gs operating to trigger the triac units T1 and T6 to blink the red light of the main road and the green light of the side road.

The embodiments of my invention herein shown and described are intended to be illustrative and not necessarily limitative of my invention since the same are subject to changes and modifications without departure from the scope of the invention being claimed.

I claim:

1. In a traffic control system comprising red, green and yellow signal lights for each direction of traffic at an intersection wherein said lights are controlled to cause only one of said lights to be "on" at anyone time in anyone direction with the yellow light following the green light in one traffic direction while the red light is "on" in a cross direction, and the lights in each direction are shifted at intervals to red and green to indicate changes in the direction of traffic: the method of signalling motorists and pedestrians by momentarily blinking the red or green light in a given direction while the light is "on" giving its normal signal followed by a continuing steady "on" condition of the light for a duration substantially greater than the duration of the blinking to indicate at the instant of said blinking a predetermined time remaining before the direction of traffic is changed.

2. The method set forth in claim 1 wherein said blinking is carried out by momentarily interrupting the power line to the red or green traffic control light at least several seconds before the yellow light comes on in the "go" direction of traffic, and then continuing to hold the power line closed.

3. The method set forth in claim 1 wherein said blinking consists of a single blink.

4. The method set forth in claim 1 wherein said blinking comprises a momentary multiple blink for a fraction of a second at a blink rate of 3 to 6 per second.

5. The method set forth in claim 4 wherein said multiple blink signal has a maximum duration less than one second.

6. The method set forth in claim 3 wherein a multiple blink up to a maximum of three blinks is a unitary signal indicating a prescribed shorter time remaining before the direction of traffic is changed, by causing said light to be blinked once at said predetermined time and to be blinked thereafter successively at a rate of 3 to 6 per second for a total duration of a fraction of a second at said prescribed shorter time followed by then holding the light steadily "on".

7. The method set forth in claim 6 wherein the duration of each blink of said single blink signal is a minor fraction of the cycle time of each blink of said multiple blink signal.

8. The method set forth in claim 1 wherein the red-green lights in cross directions of an intersection are blinked simultaneously to give motorists and pedestrians in both directions the same signals as to when the direction of traffic will change.

9. In an apparatus for controlling traffic intersection signal lights comprising red, green and yellow lights in each direction of traffic to inform motorists and pedestrians as to when the lights will change to red and to green to indicate a change in direction of traffic, wherein a predetermined blinking of a red or green light followed by a steady "on" condition is prescribed to signify that a predetermined time remains before the direction of traffic will change: the combination with a controller which shifts the lights to red and to green at respective preset time intervals, of an interrupter switch in the power line of the signal lights, timing means cyclically operable to actuate said interrupter switch during each period the lights are red or green for blinking said lights on said said prescribed time basis to signal the time remaining before the direction of traffic will change, wherein the remaining "on" time is substantially greater than the duration of the blinking and means connecting said timing means to said controller for starting each cycle of the timing means the instant the controller shifts said lights to red and to green.

10. The apparatus set forth in claim 9 wherein said controller includes adjustable means for setting the red and green-yellow lights to different periods, and said timing means includes means for setting the time of the respective cycles of the timing means to the periods of the red and green-yellow lights whereby to provide the same timed signalling during each period.

11. The apparatus set forth in claim 10 including means coupled to said controller for shifting said timing means back and forth to its cycles corresponding to said red and green-yellow periods responsive to the successive operations of said controller in shifting the lights to red and to green.

12. The apparatus set forth in claim 9 wherein said timing means includes means for intermittently operating said interrupter switch during each period the lights are red and green-yellow to provide a plurality of discrete blinking signals at successive intervals of shorter length before the direction of traffic will change, and wherein each succeeding signal is increased by one blink over the preceding signal.

13. The apparatus set forth in claim 9 wherein said timing means is of a solid-state form for producing output pulses to control said blinking signals, comprising a step counter including delay means and both single and multiple pulse generators wherein said generators are responsive to feed of an input signal from said controller to produce a single amplified output pulse followed at prescribed intervals by one or more successive pulses each of a number of pulses greater by one than the preceding, and means including a variable delay gate for varying the time of said input signal from said controller according to the period of a selected traffic signal light to start said counter to initiate said first blinking signal at a predetermined interval before the direction of traffic will change.

14. The apparatus set forth in claim 13 wherein said controller includes adjustable means for setting the red and green-yellow lights to different periods, and said timing means includes means for setting the time of the respective cycles thereof to said different periods to provide the same timed signalling during each period, including means comprising a second variable delay gate for feeding an input pulse from said controller to said counter when the controller is operated to shift to the other signal light, said second variable delay gate being set to a delay time according to the period of said other signal light to start said counter at the same predetermined interval before the direction of traffic is changed.

15. The apparatus set forth in claim 13 wherein said interrupter switch is a normally closed solid state switch connected in the power line of said signal lights and operable responsive to each pulse fed thereto for opening momentarily said power line for the duration of said pulse, and means for feeding the amplified output pulses from said pulse generators to said solid-state switch.

16. In a traffic control system comprising red, green and yellow signal lights in cross directions at a traffic intersection: the method of controlling said signal lights which comprises causing only one of said lights to be "on" in anyone direction at anyone time with the yellow light following the green light in one direction while the red light is "on" in the cross direction and vice versa, shifting said lights at intervals to red and to green in one direction while the lights are shifted to green and to red in the cross direction to indicate changes in the direction of traffic, and blinking the red light in one direction while the green light is blinked in the cross direction and vice versa, where each blinking signal comprises one or more blinks with multiple blink signals being composed of blinks at a rate of 3 to 6 per second and of a duration of a minor fraction to one second maximum, and wherein each blink signal is followed by a continuing "on" condition of the light for a duration substantially greater than the duration of the blinking signal and is of a character prescribed to signify at the instant of the blinking the time remaining before the direction of traffic will change.

* * * * *